US007905286B2

(12) United States Patent
Moody et al.

(10) Patent No.: US 7,905,286 B2
(45) Date of Patent: Mar. 15, 2011

(54) METHOD AND APPARATUS FOR SEALING A HOLE MADE WITH A CASED HOLE FORMATION TESTER

(75) Inventors: Michael J. Moody, Katy, TX (US); John M. Michaels, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 175 days.

(21) Appl. No.: 12/243,529

(22) Filed: Oct. 1, 2008

(65) Prior Publication Data

US 2010/0078171 A1 Apr. 1, 2010

(51) Int. Cl.
*E21B 29/06* (2006.01)
*E21B 33/13* (2006.01)
*E21B 43/11* (2006.01)

(52) U.S. Cl. ..... 166/298; 166/55.1; 166/55.2

(58) Field of Classification Search ..... 175/58, 175/77, 78, 4, 4.57, 4.58, 4.59; 166/297, 166/55.1, 55.2, 55, 298; 73/152.26, 152.24
See application file for complete search history.

(56) References Cited

U.S. PATENT DOCUMENTS 2,526,695 A * 10/1950 Schlumberger ..... 166/55.1
3,301,337 A * 1/1967 Vaughn et al. ..... 175/22
3,419,089 A * 12/1968 Venghiattis ..... 175/4.57
5,065,619 A 11/1991 Myska
5,195,588 A 3/1993 Dave
5,701,958 A 12/1997 Braziel
6,164,126 A 12/2000 Ciglenec et al.
6,571,867 B2 * 6/2003 Bond ..... 166/50
6,772,839 B1 8/2004 Bond

OTHER PUBLICATIONS

Schlumberger, "CHDT Cased Hole Dynamics Tester", Pressure testing and sampling in cased wells, www.slb.com/oilfield, Jun. 2003, pp. 1-6.

International Search Report and Written Opinion, Mailed May 3, 2010, International Appln. No. PCT/US2009/058757, Written Opinion 7 Pages, International Search Report 4 Pages.

* cited by examiner

*Primary Examiner* — Kenneth Thompson
(74) *Attorney, Agent, or Firm* — Cantor Colburn LLP

(57) ABSTRACT

Apparatus and methods for forming and sealing a hole in the sidewall of a borehole are provided. The method may include conveying a carrier into the borehole, forming the hole in the sidewall using a bit, and sealing at least a portion of the hole by leaving at least a portion of the bit in the hole. An apparatus includes a carrier conveyable into the borehole, and a bit disposed on the carrier that forms the hole in a sidewall, the bit including a sealing portion that seals at least a portion of the hole.

21 Claims, 5 Drawing Sheets

METHOD AND APPARATUS FOR SEALING A HOLE MADE WITH A CASED HOLE FORMATION TESTER

BACKGROUND

1. Technical Field

The present disclosure generally relates to well bore tools and in particular to methods and apparatus for forming and sealing a hole in a sidewall of a borehole.

2. Background Information

Oil and gas wells have been drilled at depths ranging from a few thousand feet to as deep as five miles. Information about the subterranean formations traversed by the borehole may be obtained by any number of techniques. Techniques used to obtain formation information include obtaining one or more formation fluid samples and/or core samples of the subterranean formations, for example. These samplings are collectively referred to herein as formation sampling.

Boreholes are often reinforced using mud cake, casings, cement, and/or liners, for example. Various methods have been developed to form one or more holes in the sidewall of a borehole and/or reinforced boreholes in order to perform tests on the formation. A typical technique for forming perforations within the sidewall of a borehole, and in particular a cased/cemented borehole is to lower a tool into the borehole that includes a shaped explosive charge for perforating the sidewall. After testing the formation, the hole formed through the sidewall of the borehole often needs to be sealed to prevent formation fluids from entering the borehole after testing, fracturing, or other operation is complete. The current methods available for sealing a hole in the sidewall of a borehole are costly and time consuming. There is a need, therefore, for improved apparatus and methods for forming and repairing holes in the sidewall of a borehole.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is a method for forming and sealing a hole in a sidewall of a borehole that includes conveying a carrier into a the borehole, forming the hole in the sidewall using a bit, and sealing at least a portion of the hole by leaving at least a portion of the bit in the hole.

Another aspect disclosed is an apparatus for forming and sealing a hole in a sidewall of a borehole that includes a carrier conveyable into the borehole and a bit disposed on the carrier that forms the hole in the sidewall, the bit including a sealing portion that seals at least a portion of the hole.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein.

DESCRIPTION OF EXEMPLARY EMBODIMENTS

Figure 1:
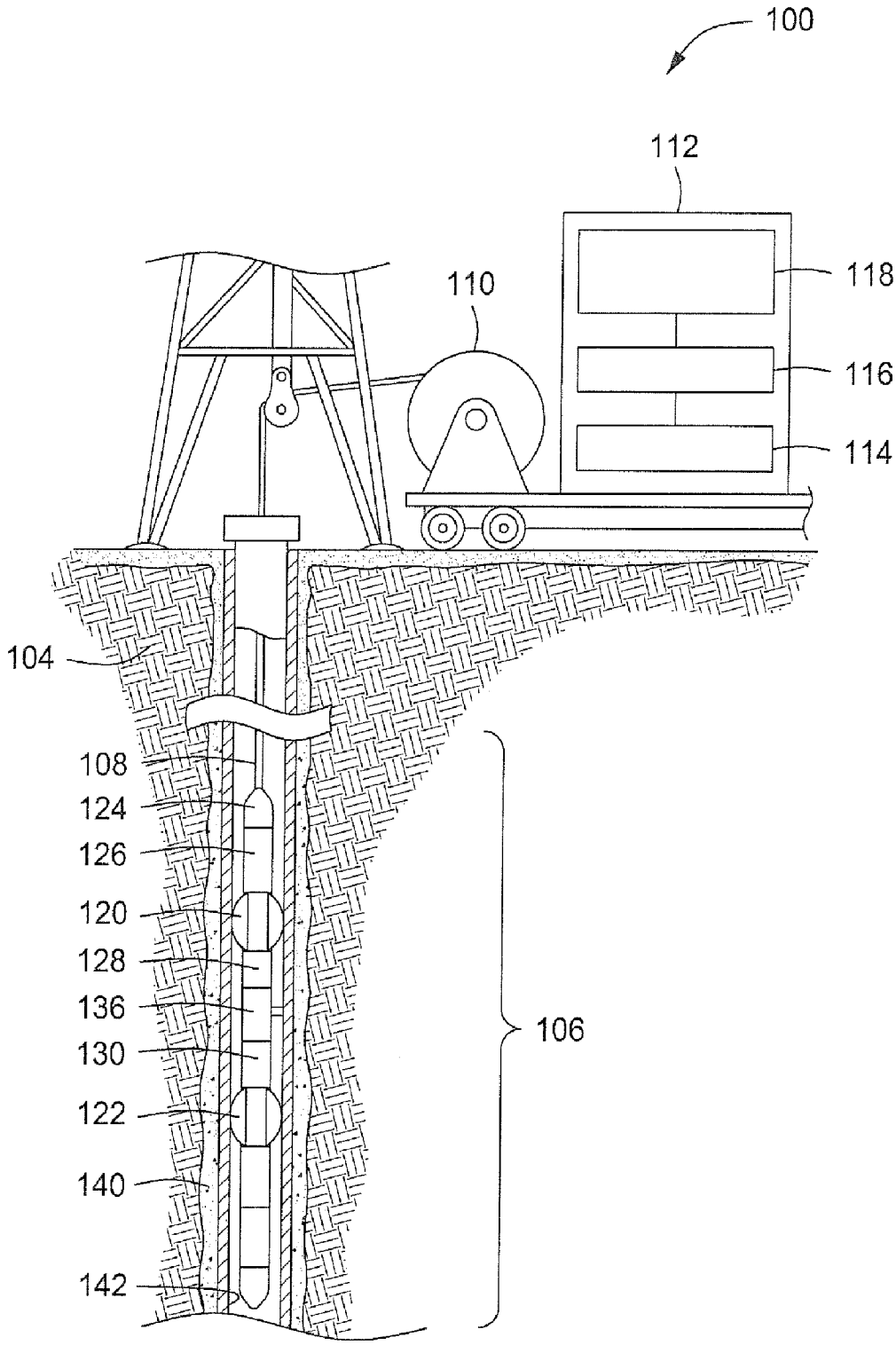
FIG. 1 is an exemplary wireline system according to one or more embodiments of the disclosure.

FIG. 1 is an exemplary wireline system 100 according to one or more embodiments of the disclosure. The wireline system 100 is shown disposed in well borehole penetrating earth formations 104 for making measurements of properties of the earth formations 104. The borehole can be filled with a fluid having a density sufficient to prevent formation fluid influx. As shown, the borehole is reinforced with cement 140 and a casing 142 that support the borehole wall and prevent formation fluid influx.

A string of logging tools, or simply, tool string 106 is shown lowered into the borehole by an armored electrical cable 108. The cable 108 can be spooled and unspooled from a winch or drum 110. The exemplary tool string 106 operates as a carrier, but any carrier is considered within the scope of the disclosure. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, bottom hole assemblies (BHA), drill string inserts, modules, internal housings and substrate portions thereof.

The tool string 106 may be configured to convey information signals to surface equipment 112 by an electrical conductor and/or an optical fiber (not shown) forming part of the cable 108. The surface equipment 112 can include one part of a telemetry system 114 for communicating control signals and data signals to the tool string 106 and may further include a computer 116. The computer can also include a data recorder 118 for recording measurements acquired by the tool string 106 and transmitted to the surface equipment 112.

The exemplary tool string 106 may be centered within the well borehole, or as shown within the casing 142 by a top centralizer 120 and a bottom centralizer 122 attached to the tool string 106 at axially spaced apart locations. The centralizers 120, 122 can be of any suitable type known in the art such as bowsprings, inflatable packers, and/or rigid vanes. In other non-limiting examples, the tool string 106 may be urged to a side of the casing 106 using one or more extendable members.

The tool string 106 of FIG. 1 illustrates a non-limiting example of a downhole tool for forming and sealing a hole in a sidewall of the borehole, along with several examples of supporting functions that may be included on the tool string 106. The tool string 106 in this example is a carrier for conveying several sections of the tool string 106 into the borehole. The tool string 106 includes an electrical power section 124, an electronics section 126, and a mechanical power section 128. A mandrel section 130 is shown disposed on the tool string 106 below the mechanical power section 128 and the mandrel section 130 includes downhole tool 136 for forming and sealing a hole in a sidewall of the borehole.

The electrical power section 124 receives or generates, depending on the particular tool configuration, electrical power for the tool string 106. In the case of a wireline configuration as shown in this example, the electrical power section 124 may include a power swivel that is connected to the wireline power cable 108. In the case of a while-drilling tool, the electrical power section 124 may include a power generating device such as a mud turbine generator, a battery module, or other suitable downhole electrical power generating device. In some examples, wireline tools may include power generating devices and while-drilling tools may utilize wired pipes for receiving electrical power and communication signals from the surface. The electrical power section 124 may be electrically coupled to any number of downhole tools and to any of the components in the tool string 106 requiring electrical power. The electrical power section 124 in the example shown provides electrical power to the electronics section 126.

The electronics section 126 may include any number of electrical components for facilitating downhole tests, information processing, and/or storage. In some non-limiting examples, the electronics section 126 includes a processing system that includes at least one information processor. The processing system may be any suitable processor-based control system suitable for downhole applications and may utilize several processors depending on how many other processor-based applications are to be included in the tool string 106. The processor system can include a memory unit for storing programs and information processed using the processor, transmitter and receiver circuits may be included for transmitting and receiving information, signal conditioning circuits, and any other electrical component suitable for the tool string 106 may be housed within the electronics section 126.

A power bus may be used to communicate electrical power from the electrical power section 124 to the several components and circuits housed within the electronics section 126 and/or the mechanical power section. A data bus may be used to communicate information between the mandrel section 130 and the processing system included in the electronics section 126, and between the electronics section 126 and the telemetry system 114. The electrical power section 124 and electronics section 126 may be used to provide power and control information to the mechanical power section 128 where the mechanical power section 128 includes electromechanical devices. Some electronic components may include added cooling, radiation hardening, vibration and impact protection, potting and other packaging details that do not require in-depth discussion here. Processor manufacturers that produce information processors suitable for downhole applications include Intel, Motorola, AMD, Toshiba, and others. In wireline applications, the electronics section 126 may be limited to transmitter and receiver circuits to convey information to a surface controller and to receive information from the surface controller via a wireline communication cable.

In the non-limiting example of FIG. 1, the mechanical power section 128 may be configured to include any number of power generating devices to provide mechanical power and force application for use by the downhole tool 136. The power generating device or devices may include one or more of a hydraulic unit, a mechanical power unit, an electro-mechanical power unit, or any other unit suitable for generating mechanical power for the mandrel section 130 and other not-shown devices requiring mechanical power.

In several non-limiting examples, the mandrel section 130 may utilize mechanical power from the mechanical power section 128 and may also receive electrical power from the electrical power section 124. Control of the mandrel section 130 and of devices on the mandrel section 130 may be provided by the electronics section 126 or by a controller disposed on the mandrel section 130. In some embodiments, the power and controller may be used for orienting the mandrel section 130 within the borehole. The mandrel section 130 can be configured as a rotating sub that rotates about and with respect to the longitudinal axis of the tool string 106. In other examples, the mandrel section 130 may be oriented by rotating the tool string 106 and mandrel section 130 together. The electrical power from the electrical power section 124, control electronics in the electronics section 126, and mechanical power from the mechanical power section 128 may be in communication with the mandrel section 130 to power and control the downhole tool 136.

Figure 2:
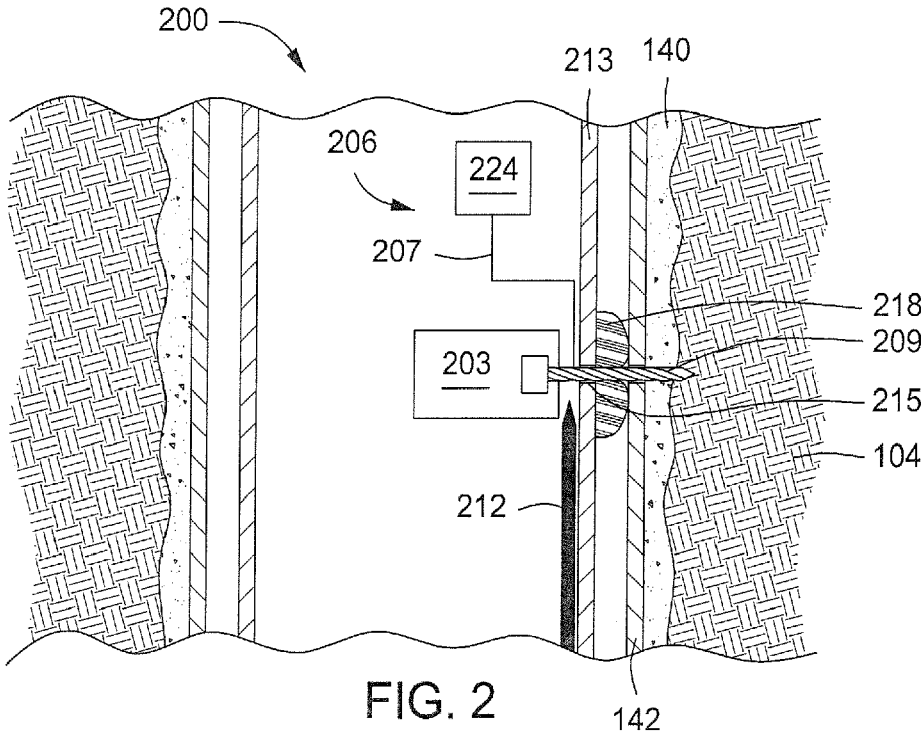
FIG. 2 illustrates a non-limiting example of forming a hole in the sidewall of a borehole using a bit and introducing a sealant to the hole, according to the disclosure.
Figure 3:
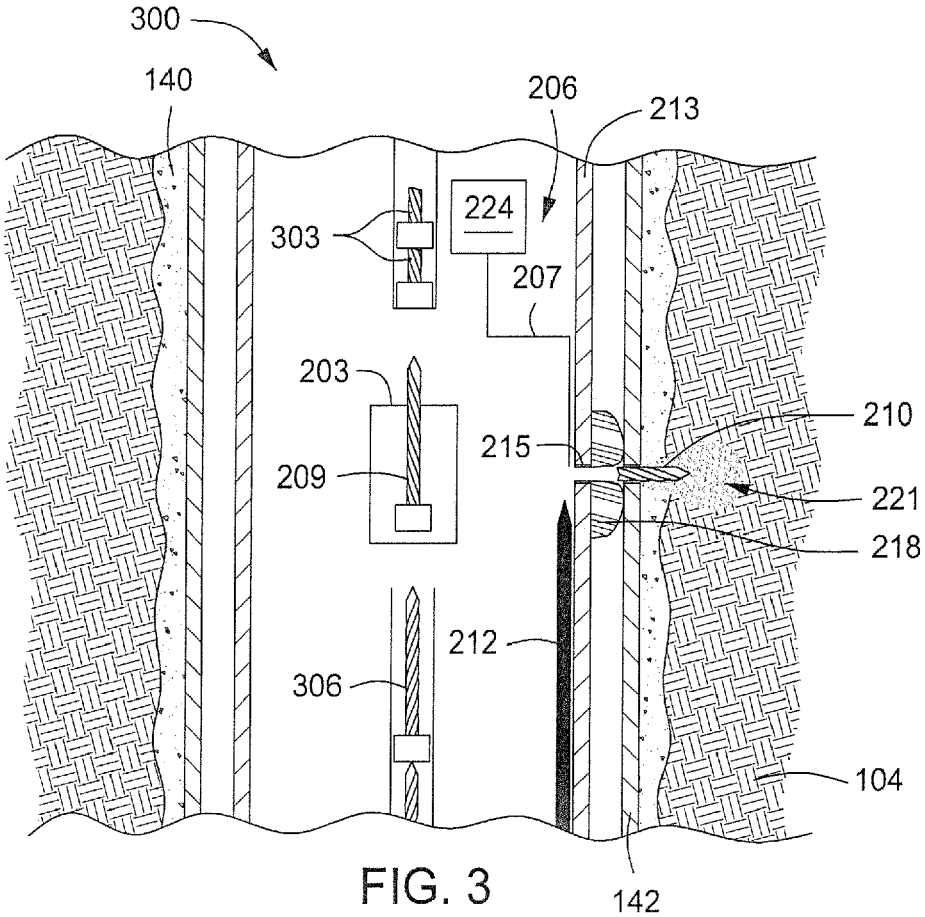
FIG. 3 illustrates a non-limiting example of a sealed hole using at least a portion of the bit and sealant according to the disclosure.

Referring now to FIGS. 2 and 3, an illustrative non-limiting downhole tool 200 according to one or more embodiments is shown. FIG. 2 shows the downhole tool 200 forming a hole through the casing 142, cement 140 and into the formation 104 using a bit 209. For simplicity and ease of description, the borehole will be further described in the context of a cased borehole reinforced with cement 140 and a casing 142. However, it is understood that open boreholes or other types of reinforced boreholes are also contemplated and within the scope of this disclosure. For example, in another embodiment, in an open borehole, that is the borehole wall is unsupported by a casing, cement, or other support system, the downhole tool can form a hole through the borehole wall and into the formation 104 using the bit 209. The tool string 106 can include a port 215 through which the bit 209 can extend to contact the casing 142. In one or more embodiments, a durable rubber pad 218 can be disposed about the port 215 such that the pad 218 contacts the casing 142. The pad 218 may be pressed against the casing 142 with enough force to form a seal between the casing 142 and the port 215. The seal formed between the pad 218 and the casing 142 can prevent or reduce any fluids within the casing from entering the downhole tool 200. The pad 218 need not be rubber and may be constructed of any suitable material for forming a seal. In some cases, the pad 218 may be eliminated.

In one or more embodiments, the downhole tool 200 includes, but is not limited to a perforator 203 and a sealer 206. The perforator 203 can include the bit 209, a chuck, a coupling, or other bit securing device, and a motor to rotate the bit, move the bit linearly forward and backward, or both. In one or more embodiments, the downhole tool 200 can include a scoring member 212. The scoring member 212 can engage the bit 209 to score about at least a portion of the perimeter of the bit 209 or along the bit 209. Preferably the scoring member 212 can score a groove about or along the bit 209. Scoring the bit can improve breaking or fracturing of the bit 209, thereby leaving at least a portion of the bit 209 within the hole formed by the bit 209.

In one or more embodiments, the bit 209 can linearly extend through the port 215 a sufficient distance to penetrate the casing 142, the cement 140, and to contact the formation 104. The bit 209 can extend from the downhole tool 200 a distance ranging from a low of about 1.3 cm, about 2.5 cm, or about 5 cm to a high of about 7 cm, about 9 cm about 11 cm, or about 13 cm. In one or more embodiments, the linear distance the bit 209 can be extended can be limited by the diameter of the tool string 106. However, using a flexible shaft to drive the bit 209 a distance greater than the diameter of the tool string 106 can be achieved.

In one or more embodiments, the sealer 206 may include any suitable sealant for sealing at least a portion of the hole formed by the bit 209. As used herein, the term "sealer" includes any mechanism, system, device, or combinations thereof suitable for use in sealing the hole formed by the bit 209. The sealer 206 may be substantially located on the downhole tool 200. In one or more embodiments, as in pill delivery tools, the sealer 206 may be partially located uphole. As shown in FIGS. 2 and 3, the sealer 206 may include a sealant reservoir or tank 224 and conduit 207. In one or more embodiments, the sealer 206 can introduce a sealant 221 via a conduit 207 to the hole formed by the bit 209 by flowing the sealant 221 to the hole along a surface portion of the bit 209. The sealer 206 can introduce the sealant 221 using a pressurized sealant tank 224, a pump, gravity, or any other suitable delivery system.

In another non-limiting embodiment, a pill, for example a tank, bag, or can of sealant can be introduced to the casing 142 using a mud circulating system as an injector. The pill can release the sealant about the casing 142 such that the sealant coats the wall of the casing 142 and/or enter into the hole formed by the bit 209 into the cement 140 and/or formation 104. The sealant can be evenly or unevenly distributed about a length or section of the casing 142. The sealant can be introduced through the tool string 106 or other carrier, dropped or dispersed directly into the casing, a mud circulating system, and/or the along a surface portion of the bit 209. The sealant 221 can prevent or otherwise reduce the tendency for formation fluid and other contaminants from leaking into the casing 142 through the hole formed by the bit 209. The sealant 221 may permeate the cement 140 and/or the formation 104 and improve the barrier provided by the bit 209 thereby reducing or eliminating the potential for formation fluid and other contaminants from leaking into the casing 142.

In one or more embodiments, the sealant 221 can be introduced from the sealer 206, via one or more conduits from the surface, and/or from the annular region between the tool 200 and the casing 142 via, for example a pill, along a surface portion of the bit 209 to the hole formed by the bit 209 and the bit 209 can then be removed leaving the sealant 221 to seal the hole. In another exemplary embodiment, the sealant 221 can be introduced from the sealer 206 and/or from the casing 142 via, for example a mud circulating system along a surface portion of the bit 209 to the hole formed by the bit 209 and the bit 209 can then be broken leaving a portion of the bit 209 and sealant 221 to seal the hole. In yet another exemplary embodiment, the sealant 221 can be introduced from the sealer 206, and/or from the casing 142 along a surface portion of the bit 209 to the hole formed by the bit 209 and the bit 209 can be pushed or otherwise urged into the hole leaving the bit 209 and some sealant 221 to seal the hole. In still yet another exemplary embodiment, the sealer 206 can be eliminated from the downhole tool 200 and only the bit 209 can be used to seal the hole formed through the casing 142, cement 140, and into the formation 104. For example, the bit 209, after forming a hole, can be pushed or otherwise urged into the hole to seal the hole formed by the bit 209. In one or more embodiments, the bit 209 can be rotated such that the sealant is urged into the hole formed by the bit 209. For example, a bit 209 that removes material by rotating the bit 209 clockwise, can be rotated counterclockwise to improve introduction of the sealant 221 into the hole formed by the bit 209. Similarly, a bit that removes material by rotating the bit 209 counterclockwise can be rotated clockwise to improve introduction of the sealant 221 into the hole formed by the bit 209.

In one non-limiting embodiment the sealant 221 may be introduced to the hole formed by the bit 209 along a surface portion of the bit 209 at a pressure greater than the hydrostatic pressure of the borehole and the formation 104. For example, the sealant 221 may be introduced at a pressure ranging from about 100 kPa to about 7,000 kPa, or about 500 kPa to about 5,000 kPa, or about 2,000 kPa to about 8,000 kPa. In one or more embodiments, the sealant 221 may be introduced at a pressure of about 300 kPa or more, about 600 kPa or more, about 800 kPa or more, or about 1,000 kPa or more above the hydrostatic pressure of the formation 104. By increasing the pressure the sealant 221 is introduced at, the depth or distance the sealant 221 can penetrate into the casing 142, cement 140, and/or formation 104 may be increased.

FIG. 3 shows a non-limiting embodiment using a portion of the bit 209 and the sealant 221 as a sealing device to seal the hole formed by the bit 209. The scoring member 212 can contact and score the bit 209 and the tool string 106 can be moved axially within the casing 142 to apply force to the scored bit 209, thereby breaking the bit 209 and leaving a portion of the bit 209 within the hole formed by the bit 209. The sealant introduced via conduit 207 can seal at least a portion of any gap between the bit and the hole formed by the bit 209 to isolate the formation from the interior of the casing 142. For example, the sealant 221 can seal gaps around the bit 209 that may be formed by flutes, channels, grooves, or other surface irregularities on the bit 209 to provide a sealed hole that can reduce or prevent formation fluid and other contaminants within the formation 104 from entering the casing 142.

FIG. 3 also illustrates the perforator 203 in a retracted position within the tool string 106 with the retained portion of the broken bit 209 deposited in a bit receptacle 303 and a new bit loaded into the perforator 203 from a bit cartridge 306. In one or more embodiments, the bit cartridge 306 can hold one or more unbroken bits 209 for use by the perforator 203 in forming one or more additional holes into the formation 104, as discussed above. Although not shown, the tool string 106 can include a mechanism, system, device, or combinations thereof that can seal the port 215 when a bit 209 is not disposed through the port 215. The perforator 203 can rotate such that the bit cartridge 306 can advance a new bit 209 into the perforator 203. Advancement of a new bit 209 into the perforator can push or otherwise eject any broken portion of a bit 209 into the bit receptacle 303. With a new bit 209 inserted into the perforator 203, the perforator can be used to form one or more additional holes through the casing 142, cement 140, and into the formation 104, as discussed above. In one or more embodiments, the entire bit 209 may be used to seal the hole formed by the bit 209 and the bit receptacle 303 can be eliminated. In one or more embodiments, the sealant 221 may be introduced along a surface portion of the bit 209 to the hole formed by the bit 209 with the bit retracted for re-use and the bit cartridge can also be eliminated.

Figure 4:
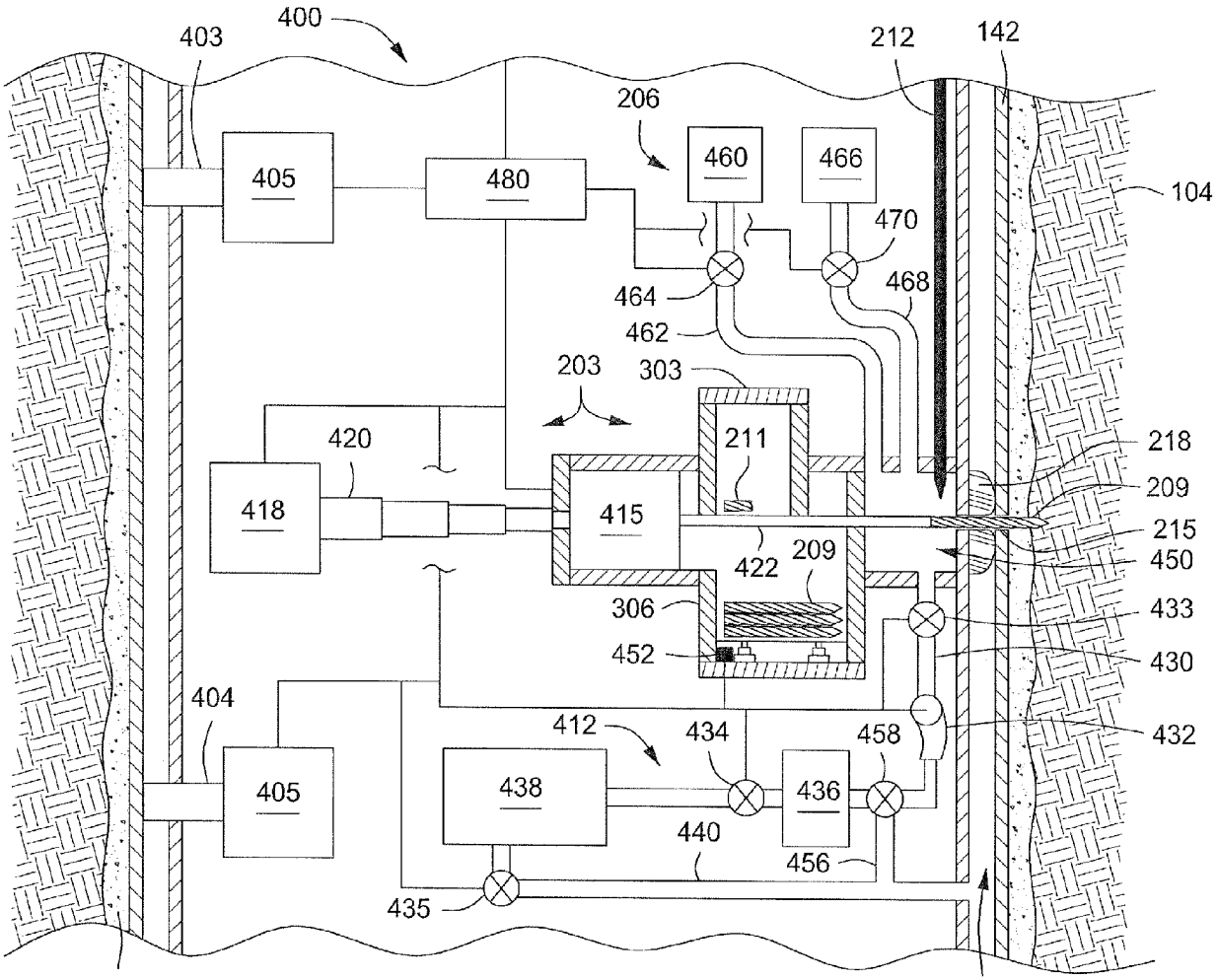
FIG. 4 is an elevation view of an illustrative non-limiting example of a downhole tool according to the disclosure.

FIG. 4 is an elevation view of an illustrative non-limiting example of a downhole tool 400 according to one or more embodiments. The downhole tool 400 can include a perforator 203, a sealer 206, a port 215, a scoring member 212, a pad 218, a bit receptacle 303, and a bit cartridge 306, which can be substantially similar as discussed and described above with reference to FIGS. 1-3. The exemplary downhole tool 400 as shown further comprises an extendable bit 209 that may be opposed by extendable feet 403, 404. The bit 209 can be rotated and/or linearly moved via motor 418 and/or motor 415. In one or more embodiments, the motor 418, the motor 415, or both can be hydraulic, pneumatic, and/or electromechanical motors. In one or more embodiments, the opposing feet 403, 404 can be extended and/or retracted via one or more hydraulic, pneumatic, and/or electro-mechanical motors 405. In one or more embodiments, the downhole tool 400 can further include a downhole evaluation system 412 for evaluating one or more formation properties. In one or more embodiments, the downhole tool 400 can include a tool control unit 480 for operating, instructing, controlling, or otherwise directing one or more functions of the downhole tool 400. In one or more embodiments, the sealer 206 and/or the downhole evaluation system 412 can be in fluid communication with a chamber 450.

In the non-limiting embodiment shown, the motor 415 can rotate the bit 209 and the motor 418 can linearly move the bit 209 horizontally, for example forward and backward. The motors 415 and 418 can operate simultaneously, separately, or both. In one or more embodiments, one motor, for example motor 415 can both rotate and linearly move the bit 209. In the non-limiting embodiment shown the motor 418 can include an extendable member 420, which can be, for example, a telescoping member that can linearly extend the bit into and out of the casing 142. The motor 415 can have a bore formed therethrough to allow advancement of the bit 209 via the extendable member 420 and as shown an optional non-extendable member 422 that can support the bit 209. The optional non-extendable member 422 can rotate via the motor 415, for example the non-extendable member 422 can have a three or more sides, one or more ridges, gears, or other protrusions, and the like that are configured to engage and rotate with the motor 415 and simultaneously, or independently linearly advance and/or retract via the extendable member 420.

As discussed and described above with reference to FIG. 3, the perforator 206 can include a bit receptacle 303 and a bit cartridge 306 for receiving broken and/or used bits 209 from the perforator 406 and for supplying new bits 209 to the perforator 406, respectively. In one or more embodiments, the bit cartridge 306 can advance a new bit to engage with the perforator 203 using any suitable mechanism, system, and/or device. For example, the bit cartridge 306 can advance a new bit using a telescoping platform operated via a motor 452 as shown, or other suitable mechanisms such as a spring or advancing track. Depending upon the particular configuration of the downhole tool 400, the bit receptacle 303, bit cartridge 306, or both can be eliminated, as discussed and described above with reference to FIG. 3.

As discussed and described above with reference to FIGS. 2 and 3, the downhole tool 400 can include a sealer 206. In one or more embodiments, the sealant 221 introduced to the hole formed by the bit 209, can include one or more components, for example a two-part epoxy. For a multi-component sealant the sealer 206 can store a first part of the epoxy in a first reservoir or tank 460 and a second part of the epoxy in a second reservoir or tank 466. Alternatively, as discussed above the sealant can be introduced from the surface via one or more conduits, through the casing via a pill, or any other suitable delivery method. The first part stored in the first tank 460 and the second part stored in the second tank 466 can be introduced to the chamber 450 via conduits 462 and 468, respectively. One or more valves 464, 468 can be used to control the amount of sealant introduced from the sealer 206 to the chamber 450. The first and second part can be mixed within the chamber 450, within a common flow line or common mixing line, not shown, or both.

In several non-limiting embodiments the sealant 221 may be any suitable medium or substance that can seal the hole formed by the bit 209 through the casing 142, cement 140, and into the formation 104. In another non-limiting embodiment the sealant may chemically react with the casing 142, cement, 140, and/or the formation 104 to seal the hole formed by the bit 209. For example, the sealant can be an acid or a base that when in contact with a particular type of formation 104 may react with the formation 104 in such a manner as to result in a reduced or non-permeable formation 104.

In at least one non-limiting embodiment the sealant 221 may be or include a substance that may increase in viscosity ("thicken") upon exposure to one or more triggers or activators. The term activator may be considered synonymous with trigger and includes any device, mechanism, member, environmental condition, or combinations thereof for modifying a property of the sealant. Non-limiting examples of suitable activators include magnetic, electromagnetic, light, acoustic, thermal, pressure, chemical, fluids, solids and combinations thereof. In another non-limiting embodiment the sealant may be or include a substance that may increase in volume ("expand") upon exposure to one or more triggers or activators. In yet another non-limiting embodiment the sealant 221 may be or include a substance that may increase in both viscosity and volume upon exposure to one or more triggers or activators.

The triggers that may activate the sealant 221 may include, but are not limited to, environmental conditions, a reactant or activator, a tool trigger, and/or a magnetic field. The environmental triggers or conditions may include, for example, temperature, pressure, the presence of oil, water, carbon dioxide, or other known or expected compounds that may be present in the formation 104. In another embodiment the environmental trigger may include a certain pH or a range of pH that may activate the sealant upon introduction to the hole formed by the bit 209. The one or more tool triggers may include, for example, a heater or a cooler disposed in the pad 218, which when either heated or cooled activates the sealant 221. The one or more tool triggers can include an acoustic wave generated by an acoustic generator. The one or more tool triggers can include a light beam such as an ultraviolet light, infrared light, a laser, an incandescent light bulb, or other suitable light emitting device that when light is irradiated toward the hole formed by the bit 209 the sealant 221 may be activated. Another tool trigger can include one or more magnets, such as a permanent magnet, an electromagnet, or both.

The sealant 221 may be a flowable solid, liquid, or gas. In one embodiment a flowable solid sealant 221 may be in the form of a powder, flake, or granule, which may be suspended in a fluid to improve or facilitate introduction of the sealant into the hole formed by the bit 209. In another non-limiting embodiment the sealant 221 may be or include a gel or other fluid that may thicken and/or expand due to a chemical reaction with one or more activating components introduced to the sealant 221. For a sealant 221 that may require an activator or activating component, the activator may be introduced to the sealant 221 or the region within the hole formed by the bit 209, before, simultaneously, and/or after the sealant 221 is introduced into the region. In one non-limiting embodiment the sealant 221 may be or include a magnetically activated sealant, such as a magneto-viscous fluid. In another embodiment the sealant 221 may be or include a shear thickening sealant. A shear thickening sealant may be introduced to the hole formed by the bit 209 through one or more nozzles directed toward a surface portion of the bit and the viscosity of a shear thickening sealant may be increased as the sealant is sheared through the one or more nozzles. In another non-limiting embodiment the sealant 221 may include a shear thinning sealant. A shear thinning sealant may be introduced to the hole formed by the bit 209 through one or more nozzles directed toward a surface portion of the bit and the viscosity of a shear thinning sealant may be decreased as the sealant is sheared through the one or more nozzles. In another non-limiting embodiment the sealant 221 may be or include a pH sensitive fluid or solid. A pH sensitive sealant 221 may be chosen based upon the known and/or expected pH of the area around the hole formed by the bit 209, which can include the fluids within the casing 142, the cement 140, and/or the formation 104.

In several non-limiting embodiments the sealant 221 may be selected to withstand the environmental conditions, such as the temperatures, pressures, and other conditions in the casing 142 and the formation 104. For example, the sealant 221 may be selected to withstand elevated temperatures ranging from about 50° C. to about 300° C. The sealant 221 may be selected to withstand a temperature of about 100° C. or more, about 150° C. or more, about 200° C. or more, or about 250° C. or more.

The time for the sealant 221 to reach a sufficient thickness, volume, or otherwise be modified to seal or at least reduce the permeation of the hole formed by the bit 209 may range from a few milliseconds to several hours. In at least one embodiment the time required for the sealant 221 to seal or at least reduce the permeation of the hole formed by the bit 209 may range from a low of about 1 second, 5 seconds, or 10 seconds to a high of about 60 seconds, about 120 seconds, or about 180 seconds.

In one or more embodiments above or elsewhere herein the sealed hole formed by the sealant 221 introduced along a portion of the bit 209, the sealant 221 and at least a portion of the bit 209, at least a portion of the bit 209 alone, or a combination thereof, may be of sufficient strength to withstand a pressure differential between the casing annulus 454 and the formation 104 of from about 1,000 kPa or more, about 1,500 kPa or more, about 2,500 kPa or more, or about 3,500 kPa or more, about 5,000 kPa or more, about 6,000 kPa or more, about 7,500 kPa or more, about 10,000 kPa or more, about 15,000 kPa or more, or about 20,000 kPa or more. In one or more embodiments, suitable reinforcement may be used in addition to the sealant 221, the sealant 221 and a least a portion of the bit 209, at least apportion of the bit alone, or a combination thereof. For example, an expandable casing liner may be used to reinforce the sealed hole.

In one or more embodiments, the downhole evaluation system 412 can include, but is not limited to a fluid flow line 430 in fluid communication with a fluid sample chamber 438. One or more pumps 432, valves 433, 434, 435, 458, and/or measurement devices 436 may be in fluid communication with the fluid flow line 430. A dump line 440 can be in fluid communication with the fluid sample chamber 438 and/or the fluid flow line 430. In one or more embodiments, the sample chamber 438 can be eliminated with the fluid flow line 430 in communication with the dump line 440.

The pump 432 can pump fluids from and/or to the chamber 450. In one or more embodiments, the pump can be any suitable type of pump, for example a rotary pump, a plunger or piston pump, a diaphragm pump, a gear pump, or any other type of pump that can displace or otherwise move a fluid. In one or more embodiments, the pump 432 can reduce the pressure within the chamber 450, which can urge formation fluid from the formation 104 into the chamber 450 and to measurement device 436, sample chamber 438, and/or dump line 440. The formation fluid from the formation 104 can wash, purge, or otherwise remove at least a portion of any particulates within the chamber, such as casing, cement, and/or formation fragments introduced to the chamber 450 during the formation of the hole via the bit 209, any sealant the may be present within the chamber 450, and/or any other non-formation fluids that may be present within the chamber 450 such as drilling fluid, drilling mud, and the like. The initial fluid that may contain particulates such as casing particulates that can flow directly to the dump line 440 via line 456 and valve 458 to the casing annulus 454. If one or more fluid tests are desired to be performed on the formation fluid recovered via line 430, valve 458 can be manipulated to introduce at least a portion of the fluid in line 430 to the one or more measurement devices 436. The fluid sample chamber 438 can be used to store a fluid sample for later testing, either downhole or at the surface.

The one or more formation properties tested or otherwise estimated can include, but are not limited to formation pressure, temperature, chemical composition such as the presence of one or more chemical compounds, and other formation and formation fluid properties. The one or more chemical compounds can include, but are not limited to one or more hydrocarbons such as olefins, esters, alkanes, asphaltenes, and other various hydrocarbons; harmful compounds, such as hydrogen sulfide, carbonyl sulfide, cyanide, hydrogen cyanide, sulfur dioxide; water and/or brine, and any other compounds.

In one or more embodiments, the pump 432, motors 415, 418, 452 405, valves 434, 438, 458, 464, and 470, and other mechanisms, systems, and/or devices may be independently controlled by the one or more controllers 480. In one or more embodiments, the controller 480 can receive information from and send information to the surface that may be used to control operation of the downhole tool 400. The one or more controllers 180 may further include programmed instructions for controlling and operating the downhole tool 400. In one or more embodiments, the controller 480 can be in communication with the electronics section 126 disposed on the tool string 106 as discussed and described above with reference to FIG. 1, which can provide instructions for operating the downhole tool 400. In one or more embodiments, the electronics section 126 disposed on the tool string 106 can independently control operation of the downhole tool 400.

In several non-limiting embodiments the downhole tools 136, 200, 300 and 400 described above and shown in FIGS. 1-4 may include a sensor cartridge. In several non-limiting embodiments the downhole tools may be used to insert one or more sensors within the hole formed by the bit. The one or more sensors may be sealed within the hole using the sealant, at least a portion of the bit, or a combination thereof. The one or more sensors may monitor one or more formation properties. For example, the one or more sensors may monitor a formation pressure, which may be communicated via wireless communication to a receiver device. The receiver device may be conveyed into the borehole and positioned within a suitable range of a sensor for communication therebetween. In one or more embodiments, the receiver device may be disposed on the one or more downhole tools 136, 200, 300, 400 or any other suitable downhole tool.

Figure 5:
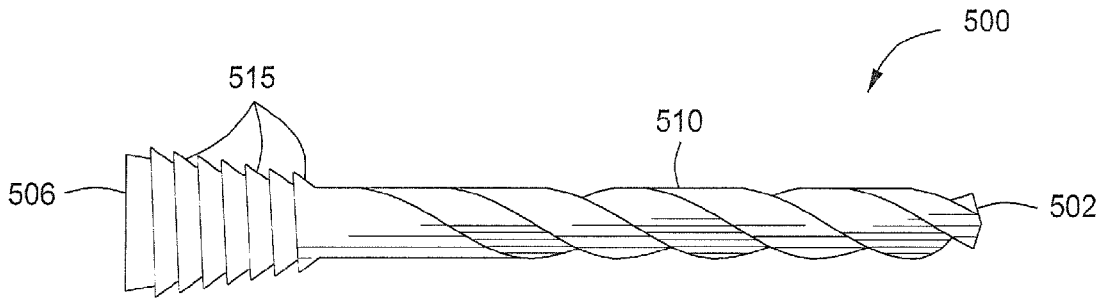
FIG. 5 is an elevation view of an illustrative bit according to the disclosure.
Figure 6:
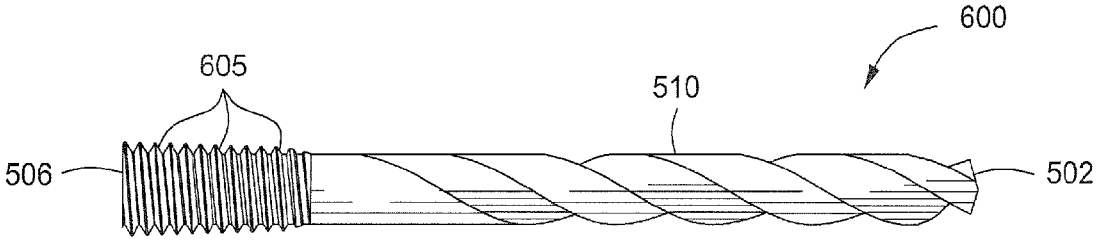
FIG. 6. is another elevation view of an illustrative bit according to the disclosure.
Figure 7:
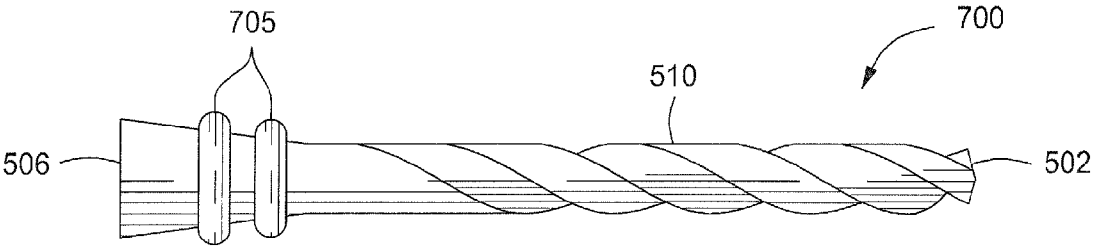
FIG. 7 is yet another elevation view of an illustrative bit according to the disclosure.

FIGS. 5-7 depict illustrative bits 500, 600, 700 according one or more embodiments. The exemplary bits 500, 600, 700 may be any suitable bit for forming a hole in the sidewall of a borehole and/or a reinforced borehole into the formation 104.

The bits can include a cutting end 502, a tool contact end 506 and an elongated shaft 510 disposed therebetween. In one or more embodiments, the cross-section of the bits can be uniform, for example a constant diameter or the cross-section can vary. In one or more embodiments, the bits can expand at the tool contact end 506 to provide bits having a larger cross-section at the tool contact end 506 than the cutting end 502 and/or shaft 506. In at least one embodiment the bits can have a circular diameter with the tool contact end 506 expanding radially from a central axis.

In one or more embodiments, the expanding tool contact end 506 may be used as a portion of a bit seal. For example, the greater cross-sectional area of the bit at the expanding tool contact end 506 can provide for a bit that can be wedged or otherwise secured into the hole formed by the bit. One or more securing modifications can be disposed about the surface of the bit, for example about an expanding tool contact end 506. The securing modifications can include, but are not limited to ridges, protrusions, threads, o-rings, and the like.

In one or more embodiments, a tapered pin may be used to expand the tool contact end 506. The perforator 203, shown in FIGS. 2-4 may also include a tapered or pointed pin or rod that may be forced into a recess or hole disposed within the tool contact end 506 of the bit 209. The force applied by the perforator 203, the extendable feet 403, 404, and/or other equipment can push or otherwise urge the tapered pin into the recess, which may expand the tool contact end 506.

In one or more embodiments, the bits 500, 600, 700 can include one or more grooves, channels, flutes, or other surface modifications about at least apportion of the length of the bit. For example, one or more flutes may extend from the cutting end 502 to the tool contact end 506. The one or more flutes can assist in removing cuttings away from the cutting end 502. In one or more embodiments, the one or more flutes or other surface modifications can also assist in introducing the sealant 221 along a surface portion of the bit into the hole formed by the bit. For example, as discussed and described above, the bits can be rotated counterclockwise and as the sealant 221 as described above with reference to FIGS. 2 and 3 is introduced to a surface portion of the bit the one or more flutes can act as a guide in which the sealant can flow into the hole formed by the bit.

In one or more embodiments, the bits 500, 600, 700 can include a recess or hole within the end of the contact end 506. For example, a star shaped hole or recess can be formed within a portion of the contact end 506, and a complimentary star tipped rod connected to the perforator 203, shown in FIGS. 2-4, which can rotate the bits. In one or more embodiments, the star shaped hole can be any suitably shaped hole, for example a triangle, square, pentagon, or any other polygonal shaped hole. In one or more embodiments, the hole or recess may be disposed on the perforator 203 with the complimentary shaped rod disposed on or about the contact end 506 of the bit.

In several non-limiting embodiments the bits 500, 600, and/or 700 may include one or more sensors disposed within the bit. For example, a sensor may be disposed within the elongated shaft of the bits. The sensor may be disposed anywhere within the elongated shaft 510 between the cutting end 502 and the tool contact end 506. In one or more embodiments, one or more holes may extend from the location of a sensor within the bit to the outer surface of the bit. The one or more holes may provide fluid communication between the sensor and the formation when the bit is disposed within the hole formed by the bit. Fluid communication between the sensor and the formation may permit the sensor to monitor one or more formation properties, for example the formation pressure. Any other formation property in addition to or in lieu of the formation pressure may be monitored by one or more sensors. Multiple formation properties may be monitored using a plurality of sensors designed for monitoring a specific formation property. Multiple formation properties may also be monitored by using a single sensor designed for monitoring a plurality of formation properties.

Disposing one or more sensors within the bits 500, 600, and/or 700 may provide a reliable and consistent method for inserting one or more sensors within a hole formed by the bit and sealed using at least the portion of the bit that includes the one or more sensors. For example, a sensor may be disposed within the bit at a known position which can place the sensor at a known location within the formation. Placing sensors within the formation at known locations may improve the reliability of information provided by the one or more sensors.

Disposing one or more sensors within the bits 500, 600, and/or 700 may provide placement of the one or more sensors within the formation 104 with reduced or no shock to the one or more sensors that can often occur using current methods, such as firing a sensor into the formation. Disposing one or more sensors within the bits can also reduce the time required for downhole operations as both a formation sample may be measured by the downhole tools 136, 200, 300, 400 and upon sealing the hole formed by the bit the one or more sensors may also be left within the formation 104 for future monitoring of one or more formation properties.

Referring to FIG. 5, the tool contact end 506 can include one or more surface modifications for holding or otherwise securing the bit 500 within the casing 142, the cement 140, and/or the formation 104. As shown, the bit 500 includes a plurality of angularly oriented protrusions 515 adapted to engage with the casing 142, cement 140, and/or the formation 104 to secure and prevent the bit from coming out of the hole formed by the bit 500. If sealant is also introduced to the hole formed by the bit 500, the sealant can improve the sealing qualities provided by the bit 500.

Referring to FIG. 6, the tool contact end 506 can include one or more surface modifications for holding or otherwise securing the bit 600 within the casing 142, the cement 140, and/or the formation 104. As shown, the bit 600 includes a tool contact end 506 having threads 605. The threads 605 can be self-tapping. The threads 605 can be oriented such that when urged into the hole formed by the bit 600, the tool contact end 506 may be rotated to screw into and secure the bit 600 within the hole formed by the bit 600. The threads 605 can be oriented, such that the bit 600 can be screwed into the casing 142, cement 140, and/or formation 104 clockwise or counterclockwise. The threads 605 can be "self-tapping" threads. If sealant is also introduced to the hole formed by the bit 600, the sealant can also improve the sealing qualities provided by the bit 600

Referring to FIG. 7, the tool contact end 506 can include one or more surface modifications for holding or otherwise securing the bit 700 within the casing 142, the cement 140, and/or the formation 104. As shown, the bit 700 includes a tool contact end 506 having one or more O-rings 705. The O-rings 705 can exert an outward force that can engage the walls of the hole formed by the bit, thereby securing the bit 700 within the hole formed by the bit.

In one or more embodiments, the O-rings 705 may be disposed within a groove or other recess about the tool contact end 506. The groove or other recess can secure the O-ring 705 about the tool contact end 506. The O-rings 705 can be the same size or different sizes, which may depend upon the location of the O-ring 705 on the tool contact end 506. For example, an O-ring disposed about the tool contact end 506 closer to the cutting end 502 than the end of the tool contact end 506 may have a smaller outer diameter than an O-ring 705 disposed closer to the end of the tool contact end 506 than the cutting end 502. If sealant is also introduced to the hole formed by the bit 600, the sealant can also improve the sealing qualities provided by the bit 600. While O-Rings 705 are shown, those skilled in the art with the benefit of the present disclosure will recognize that rigid rings or rigid C-rings, which can be inserted into the groove or recess about the tool contact end 506, may be used. The O-rings 705, rigid rings and C-Rings can be made from any suitable material. Illustrative materials can include metals such as steel, non-metals such as rubber or polymers, or combinations thereof.

In one or more embodiments above or elsewhere herein the bits 209, 500, 600, and 700 can be made from any suitable material or combination of materials. Suitable materials for making the bits can include, but are not limited to carbon steel, steel, high speed steel, titanium nitride, tungsten carbide, cobalt, tantalum carbide, niobium carbide, zirconium carbide, titanium carbide, vanadium carbide, diamond, or any combination thereof. For example, the bits can be substantially made from tungsten carbide and can include diamond powder coated and/or disposed within the cutting end 502. In another embodiment, the bits can be substantially made of carbon steel, but can include a high speed steel cutting end 502, for example. The particular materials used to make the bits can be selected based the borehole, whether it is reinforced or un-reinforced, the casing material and/or thickness, the type and/or thickness of cement used to hold the casing 142 in place, and composition of the formation 104, and/or the pressures present where the hole is formed in the casing using the bit.

In one or more embodiments, above or elsewhere herein the scoring tool 212 can be made from any suitable material. Suitable materials for making the scoring tool 212 can include, but are not limited to carbon steel, steel, high speed steel, titanium nitride, tungsten carbide, cobalt, tantalum carbide, niobium carbide, zirconium carbide, titanium carbide, vanadium carbide, diamond, or any combination thereof. In one or more embodiments, the scoring tool 212 can be made from the same material as the bit or a harder material than the bit. For example, the scoring tool 212 can be made from tungsten carbide and the bit can be made from carbon steel. In another embodiment, the scoring tool 212 can include diamonds which can score a bit made from metals and/or metal alloys. A scoring tool 212 that is harder than the bit can score the bit more effectively.

Figure 8:
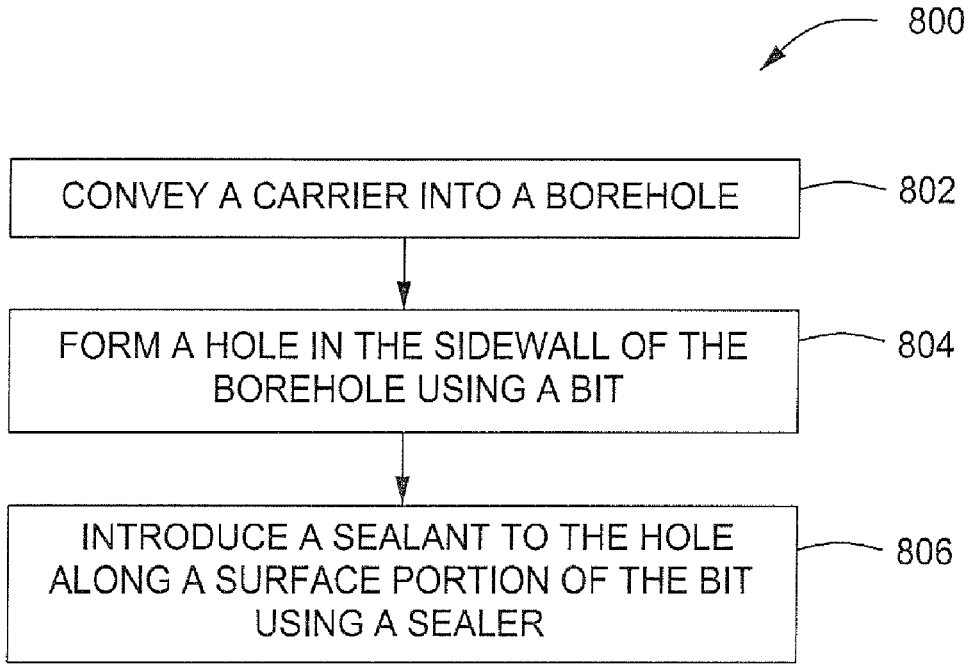
FIG. 8 illustrates a non-limiting example of a method for forming and sealing a hole in a sidewall of a borehole according to the disclosure.

FIG. 8 illustrates one example of a non-limiting method 800 according to the disclosure. The method 800 includes conveying a carrier into a borehole 802. The carrier may include a downhole tool coupled to the carrier. The downhole tool may be substantially similar to the downhole tools 136, 200, 300, and 400 described above and shown in FIGS. 1-7. That is the downhole tool includes a bit and a sealer. The method 800 may further include forming a hole in the sidewall of the borehole using the bit 804. The method 800 also includes introducing a sealant to the hole along a surface portion of the bit using the sealer 806. In one non-limiting embodiment the sealant may be introduced via a pill to the borehole, where the sealant may flow along a surface portion of the bit into the hole. The method 800 may optionally include rotating the bit as the sealant flows along a surface portion of the bit to improve introduction of the sealant to the hole formed by the bit. The method 800 may optionally include measuring at least one formation property through the hole before introducing the sealant to the hole. In one or more embodiments, the method 800 may include recovering one or more formation fluid samples through the hole before introducing the sealant to the hole.

Figure 9:
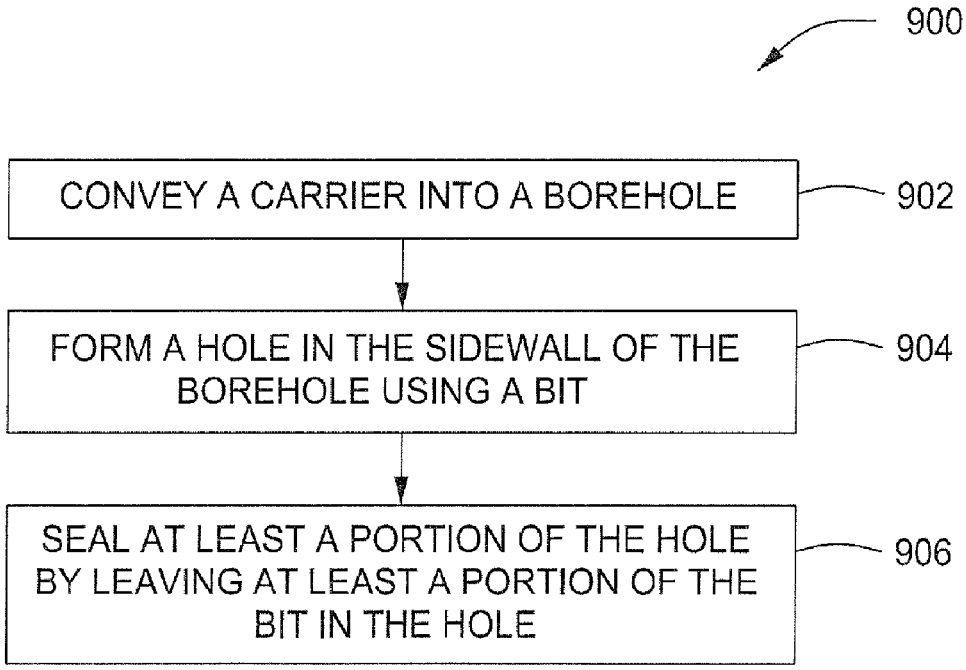
FIG. 9 illustrates another non-limiting example of a method for forming and sealing a hole in a sidewall of a borehole according to the disclosure.

FIG. 9 illustrates another example of a non-limiting method 900 according to the disclosure. The method 900 includes conveying a carrier into a borehole 902. The carrier may include a downhole tool coupled to the carrier. The downhole tool may be substantially similar to the downhole tools 136, 200, and 400 described above and shown in FIGS. 1-7. That is the downhole tool includes a bit and a sealer. The method 900 may further include forming a hole in the sidewall of the borehole using a bit 904. The method 900 also includes sealing at least a portion of the hole formed by the bit by leaving at least a portion of the bit in the hole. In one non-limiting embodiment the entire bit may be used to seal at least a portion of the hole. In another non-limiting embodiment the bit may be scored by a scorer and the downhole tool may be moved axially to forcefully break the bit, thereby leaving a portion of the bit within the hole. The method 900 may optionally include measuring at least one formation property through the hole before introducing at least a portion of the bit into the hole to seal at least a portion of the hole. In one or more embodiments, the method 900 may include recovering one or more formation fluid samples through the hole before introducing at least a portion of the bit into the hole to seal at least a portion of the hole.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

Given the above disclosure of general concepts and specific embodiments, the scope of protection is defined by the claims appended hereto. The issued claims are not to be taken as limiting Applicant's right to claim disclosed, but not yet literally claimed subject matter by way of one or more further applications including those filed pursuant to the laws of the United States and/or international treaty.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

What is claimed is:

1. A method for forming and sealing a hole in a sidewall of a borehole, comprising:

conveying a carrier into the borehole;

forming the hole in the sidewall using a cutting end and a shaft portion of a drill bit, the shaft portion configured to remove cuttings away from the cutting end; and sealing at least a portion of the hole by removing at least part of the shaft portion and leaving the at least part of the shaft portion of the drill bit in the hole.

2. The method of claim 1, wherein the borehole is one of a cased hole and an open hole.

3. The method of claim 1, wherein the hole is formed by rotating the bit, linearly actuating the bit, or both.

4. The method of claim 1, wherein the hole provides communication between a formation surrounding the borehole and a measurement device adapted to measure at least one property of the formation, the method further comprising measuring at least one formation property communicated via the hole.

5. The method of claim 4, wherein the at least one measurement device includes one or more of an acoustic sensor, an optical sensor, a displacement sensor, a strain sensor, a deflection sensor, a chemical composition sensor, a temperature sensor, and a pressure sensor.

6. The method of claim 1, further comprising scoring at least a portion of the bit.

7. The method of claim 1, further comprising axially moving the carrier within the borehole with at least a portion of the bit disposed in the hole, wherein a force provided by the axial movement breaks the bit.

8. The method of claim 1, further comprising sealing at least a portion of the hole by introducing a sealant about at least a portion of the bit.

9. The method of claim 8, wherein the sealant is introduced using at least one of a pump, a pressurized sealant storage device, and a pill.

10. An apparatus for forming and sealing a hole in a sidewall of a borehole, comprising:

a carrier conveyable into the borehole; and a bit disposed on the carrier that forms the hole in the sidewall, the bit including cutting end and a shaft portion, the shaft portion configured to remove cuttings away from the cutting end, at least part of the shaft portion configured to be removed and form a sealing portion that seals at least a portion of the hole.

11. The apparatus of claim 10, wherein the borehole is one of a cased hole and an open hole.

12. The apparatus of claim 10, wherein the carrier is a wireline, a wireline sonde, a slickline sonde, a drop shot, a downhole sub, a bottom hole assembly, a drill string insert, a module, an internal housing, a substrate portion thereof, or any combination thereof.

13. The apparatus of claim 10, wherein the shaft portion includes at least one of a groove, a channel, and a flute disposed about at least a portion of the surface of the bit.

14. The apparatus of claim 10, wherein the bit includes one or more protrusions, threads, o-rings, or any combination thereof.

15. The apparatus of claim 10, further comprising a sealer operable to introduce a sealant to at least a portion of the hole.

16. The apparatus of claim 15, wherein the sealer includes at least one of a pump, a pressurized sealant storage device, and a pill.

17. The apparatus of claim 10, further comprising a scoring device coupled to the carrier.

18. The apparatus of claim 17, wherein the scoring device is adapted to score at least a portion of the shaft portion.

19. The apparatus of claim 17, wherein the scoring device includes a material at least as hard as the bit.

20. The apparatus of claim 11, further comprising at least one measurement device to estimate at least one property of a formation.

21. The apparatus of claim 20, wherein the at least one measurement device includes one or more of an acoustic sensor, an optical sensor, a displacement sensor, a strain sensor, a deflection sensor, a chemical composition sensor, a temperature sensor, and a pressure sensor.

* * * * *